US007033718B2

(12) United States Patent
Tomita et al.

(10) Patent No.: US 7,033,718 B2
(45) Date of Patent: Apr. 25, 2006

(54) TONER AND IMAGE FORMING APPARATUS USING THE TONER

(75) Inventors: Masami Tomita, Numazu (JP); Hiroaki Matsuda, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/707,000

(22) Filed: Nov. 14, 2003

(65) Prior Publication Data

US 2004/0106057 A1 Jun. 3, 2004

(30) Foreign Application Priority Data

Nov. 15, 2002 (JP) ..... 2002-332493
Jan. 22, 2003 (JP) ..... 2003-014068

(51) Int. Cl.
*G03G 9/87* (2006.01)

(52) U.S. Cl. ..... 430/108.6; 430/108.7; 430/109.4; 430/110.3; 430/111.41; 399/119; 399/252

(58) Field of Classification Search ..... 430/110.3, 430/109.4, 111.41, 108.6, 108.7, 137.1, 137.17, 430/111.4; 399/119, 252
See application file for complete search history.

(56) References Cited

U.S. PATENT DOCUMENTS

| | | | | |
|---|---|---|---|---|
| 5,328,795 | A * | 7/1994 | Yamashiro et al. | 430/137.19 |
| 5,430,526 | A * | 7/1995 | Ohkubo et al. | 399/159 |
| 6,140,000 | A * | 10/2000 | Yamashita | 430/108.2 |
| 6,593,048 | B1 | 7/2003 | Sasaki et al. | 430/106.1 |
| 2003/0152859 | A1 * | 8/2003 | Emoto et al. | 430/109.4 |

FOREIGN PATENT DOCUMENTS

| | | | |
|---|---|---|---|
| EP | 0 390 527 | A2 | 10/1990 |
| EP | 0 475 731 | A2 | 3/1992 |
| JP | 61-22354 | | 1/1986 |
| JP | 2-148046 | | 6/1990 |
| JP | 5-313416 | | 11/1993 |
| JP | 6-250439 | | 9/1994 |
| JP | 9-68823 | | 3/1997 |
| JP | 2000-172005 | * | 6/2000 |
| JP | 2002-148863 | | 5/2002 |
| JP | 2002-207317 | | 7/2002 |
| JP | 2003-295494 | * | 10/2003 |

OTHER PUBLICATIONS

Japanese Patent Office machine-assisted translation of JP 2000-172005 (pub. Jun. 2000), copyright 1998.*
Diamond, A.S., ed., *Handbook of Imaging Materials*, Marcel Dekker, Inc., NY (1991), pp. 168-169.*
Japanese Patent Office machine-assisted translation of JP 2003-295494 (pub. Oct. 2003).*
U.S. Appl. No. 10/607,014, filed Jun. 27, 2003, Tomita, et al.
U.S. Appl. No. 10/250,667, filed Jul. 7, 2003, Emoto, et al.
U.S. Appl. No. 10/645,804, filed Aug. 22, 2003, Tomita, et al.
U.S. Appl. No. 10/670,320, filed Sep. 26, 2003, Watanabe, et al.
U.S. Appl. No. 10/680,246, filed Oct. 8, 2003, Sugiyama, et al.
U.S. Appl. No. 10/681,185, filed Oct. 9, 2003, Sugiyama, et al.
U.S. Appl. No. 10/724,260, filed Dec. 1, 2003, Emoto, et al.
U.S. Appl. No. 10/724,150, filed Dec. 1, 2003, Tomita, et al.
U.S. Appl. No. 10/712,026, filed Nov. 14, 2003, Tomita, et al.
U.S. Appl. No. 10/879,741, filed Jun. 30, 2004, Togashi et al.
U.S. Appl. No. 10/394,265, filed Mar. 24, 2003, Nanya, et al.
U.S. Appl. No. 10/286,791, filed Nov. 4, 2002, Sugiyama, et al.
U.S. Appl. No. 10/247,639, filed Sep. 20, 2002, Sugiyama, et al.
U.S. Appl. No. 10/244,526, filed Sep. 17, 2002, Sugiyama, et al.
U.S. Appl. No. 10/246,601, filed Sep. 19, 2002, Emoto, et al.
U.S. Appl. No. 10/284,177, filed Oct. 31, 2002, Sugiyama, et al.
U.S. Appl. No. 10/286,816, filed Nov. 4, 2002, Emoto, et al.
U.S. Appl. No. 10/112,769, filed Apr. 2, 2002, Sugiyama, et al.
U.S. Appl. No. 10/188,049, filed Jul. 3, 2002, Sugiyama, et al.
U.S. Appl. No. 10/158,069, filed May 31, 2002, Matsuda, et al.
U.S. Appl. No. 10/092,920, filed Mar. 8, 2002, Yamashita.
U.S. Appl. No. 10/098,556, filed Mar. 18, 2002, Sugiyama, et al.
U.S. Appl. No. 10/020,925, filed Dec. 19, 2001, Mochizuki, et al.

(Continued)

*Primary Examiner*—Janis L. Dote
(74) *Attorney, Agent, or Firm*—Oblon, Spivak, McClelland, Maier & Neustadt, P.C.

(57) ABSTRACT

A toner including toner particles including a binder resin and a colorant, wherein particles of the toner have such a rolling property as to relatively easily roll in one direction compared to other directions. It is preferable that the toner particles preferably have a spindle form and satisfies the following relationships: $0.5 \leqq (r2/r1) \leqq 0.8$, $0.7 \leqq (r3/r2) \leqq 1.0$, and $r3 \leqq r2 \leqq r1$, wherein r1, r2 and r3 represent an average major axis particle diameter, an average minor axis particle diameter and an average thickness of the toner particles. An image forming apparatus including at least an image bearing member; a developing device configured to develop an electrostatic latent image with a developer including the above-mentioned toner; a transferring device configured to transfer a toner image onto a receiving material; and a cleaning device configured to clean a surface of the image bearing member.

22 Claims, 7 Drawing Sheets

OTHER PUBLICATIONS

U.S. Appl. No. 10/101,756, filed Mar. 21, 2002, Matsuda, et al.
U.S. Appl. No. 10/077,813, filed Feb. 20, 2002, Matsuda, et al.
U.S. Appl. No. 09/986,023, filed Nov. 7, 2001, Sugiyama, et al.
U.S. Appl. No. 09/996,585, filed Nov. 30, 2001, Higuchi, et al.
U.S. Appl. No. 09/965,826, filed Oct. 1, 2001, Higuchi, et al.
U.S. Appl. No. 09/905,872, filed Jul. 17, 2001, Sasaki, et al.
U.S. Appl. No. 10/707,000, filed Nov. 14, 2003, Tomita et al.
U.S. Appl. No. 10/921,993, filed Aug. 20, 2004, Amemiya et al.
U.S. Appl. No. 10/921,923, filed Aug. 20, 2004, Koike et al.
U.S. Appl. No. 10/960,084, filed Oct. 8, 2004, Yamada, et al.
U.S. Appl. No. 11/143,982, filed Jun. 3, 2005, Arai et al.
U.S. Appl. No. 11/100,813, filed Apr. 7, 2005, Ojimi et al.

* cited by examiner

TONER AND IMAGE FORMING APPARATUS USING THE TONER

BACKGROUND OF THE INVENTION

1. Field of the Invention

The present invention relates to a toner which is used for developing an electrostatic latent image formed by an image forming method such as electrophotography. In addition, the present invention also relates to an image forming apparatus producing images using a toner, such as copiers, facsimiles and printers.

2. Discussion of the Background

In electrophotography, images are typically formed by the following method:

(1) an image bearing member such as photoreceptors is charged with a charger (charging process);
(2) imagewise light irradiates the charged image bearing member to form an electrostatic latent image on the image bearing member (light irradiating process);
(3) the electrostatic latent image is developed with a developer including a toner to form a toner image on the image bearing member (developing process);
(4) the toner image is transferred onto a receiving material optionally via an intermediate transfer medium (transfer process);
(5) the toner image is fixed on the receiving material by a fixing device upon application of heat, pressure and/or the like (fixing process); and
(6) toner particles remaining on the image bearing member even after the transfer process are removed by a cleaner so that the image bearing member can be ready for the next image forming processes.

Recently, images formed by electrophotography are requested to have high image qualities (especially, good image reproducibility) whether the images are monochrome images or color images. In particular, in full color images half tone images typically have a large image area proportion. In attempting to produce high quality color images having good evenness and good color reproducibility, toners having a small particle diameter and/or a spherical form have been proposed and developed.

Published unexamined Japanese Patent Applications Nos. (hereinafter JOPs) 2002-148863, 05-313416 and 02-148046 have disclosed methods for manufacturing a toner which include the following processes:

(1) mother toner particles including at least a binder resin and a colorant are dispersed in water or an aqueous solvent including a dispersant to prepare a dispersion;
(2) a mixture of a softening solvent which can soften the mother toner particles, and an organic solvent which can be mixed with water or the aqueous solvent and the softening solvent is added to the dispersion so that the mother toner particles absorb the softening solvent; and
(3) the softening solvent is removed from the mother toner particles.

By using these methods, spherical toners with a proper particle diameter distribution can be prepared while a variety of resins can be used as the binder resin.

However, the toners prepared by these methods have a drawback in that toner particles tend to invade into a gap between an image bearing member (e.g., photoreceptor) and a cleaner because of easily roll (i.e., having an excessive rolling property), thereby causing a cleaning problem in that undesirable streak images are produced in the resultant images. In addition, the toners have a drawback in that when a dot image is developed and transferred, toner particles in a dot image scatters around the dot image due to their excessive rolling property, resulting in occurrence of fogging.

In addition, JOPs 61-22354, 06-250439 and 09-68823 have disclosed toners which include toner particles including a colorant and a binder resin, wherein the toner particles have a volume average particle diameter of from 3 to 9 μm and a specific particle diameter distribution.

By using these toners having a small particle diameter, images having good evenness can be produced without causing a background development problem in that the resultant images have background fouling due to undesirable charge properties of the toners.

However, the toners have a drawback in that toner particles tend to invade into a gap between a photoreceptor and a cleaner in the cleaning process, resulting in occurrence of the cleaning problem. In addition, when the toners have an irregular form, the toners do not cause the cleaning problem, but another problem occurs in that the resultant images have poor fine line reproducibility because toner particles move differently when toner images are formed and transferred.

In addition, JOP 2002-207317 discloses a toner having a flat form. The toner is prepared by the following method:

(1) resin particles having an average primary particle diameter of from 10 to 500 nm is subjected to a salting-out/fusion treatment to prepare secondary particles of the resin; and
(2) the secondary resin particles are flattened to prepare the flat toner.

By using this flat toner, high image-density and high quality images having smooth surface can be produced without causing the fogging problem.

However, the toner has poor fluidity, and thereby the toner particles cannot be densely and uniformly arranged in a dot toner image. Therefore, when images are formed at a high dot (or linear) density, the toner images have poor dot reproducibility.

Because of these reasons, a need exists for a toner which can produce high quality images without causing the fogging problem and without deteriorating fine dot reproducibility.

SUMMARY OF THE INVENTION

Accordingly, an object of the present invention is to provide a toner which can produce high quality images without causing the fogging problem and without deteriorating fine dot reproducibility.

Another object of the present invention is to provide a toner which includes toner particles having charge quantities with a small standard deviation and which can produce high quality images without background development.

Yet another object of the present invention is to provide an image forming apparatus which can produce high quality images without causing the fogging and background development problems and without deteriorating fine dot reproducibility.

Briefly these objects and other objects of the present invention as hereinafter will become more readily apparent can be attained by a toner which includes at least a binder resin and a colorant, wherein particles of the toner have such a rolling property as to relatively easily roll in one direction compared to other directions when the particles are present on a two-dimensional plane (i.e., different rolling properties in the X and Y directions).

It is preferable that a material such as charge controlling agents is fixed on the surface of the toner to protect the surface of the toner. When a charge controlling agent is fixed on the surface of the toner, the content of the charge controlling agent is preferably from 0.2 to 2.0% by weight.

In addition, the toner preferably has a spindle form and a volume average particle diameter of from 3 to 8 μm. The toner preferably satisfies the following relationships:

$$0.5 \leqq (r2/r1) \leqq 0.8,\ 0.7 \leqq (r3/r2) \leqq 1.0,\ \text{and}\ r3 \leqq r2 \leqq r1,$$

wherein r1, r2 and r3 represent the average major axis particle diameter, the average minor axis particle diameter and the average thickness of the toner particles.

It is preferable that the average major axis particle diameter r1 is from 5 to 9 μm, the average minor axis particle diameter r2 is from 2 to 6 μm, and the average thickness is from 2 to 6 μm. In addition, it is preferable that the standard deviations of r1, r2 and r3 are not greater than 2.0 μm, 1.5 μm and 1.5 μm, respectively. Further, it is preferable that particles having a thickness r3 not greater than 3 μm are included in an amount not greater than 30% by weight based on the total weight of the toner.

The toner preferably has an average form factor SF-2 of from 100 to 190, wherein the form factor of a particle of the toner is defined as follows:

$$SF\text{-}2=\{(\text{PERI})^2/\text{AREA}\}\times(100\pi/4) \quad (1)$$

wherein PERI and AREA respectively represent the periphery length and the area of an image of a toner particle projected on a two-dimensional plane. The form factor of the toner is determined by averaging the form factors of 100 particles.

It is preferable that particles of the toner relatively easily roll around a rolling axis, and a projection is present on an end portion of the particles, wherein the projection is present on the rolling axis direction.

The toner preferably has a charge quantity of from 15 to 40 μC/g and a charge quantity distribution such that the half width of the charge quantity distribution curve is from 0.5 to 4.0 fC/μm.

The binder resin preferably includes a polyester resin. The toner is preferably prepared by a method including the steps of dissolving or dispersing a toner composition, which includes a modified polyester resin, in an organic solvent to prepare a toner composition liquid and then dispersing the toner composition liquid in an aqueous medium. Alternatively, the method may include the steps of dissolving or dispersing a toner composition, which includes a polyester prepolymer, in an organic solvent to prepare a toner composition liquid and then dispersing the toner composition liquid in an aqueous medium, wherein a modified polyester resin, such as one having a urea bonding, is prepared from the polyester prepolymer during the dissolving or dispersing step and the second dispersing step.

The binder resin preferably include a modified polyester resin (i) and an unmodified polyester resin (ii), wherein the weight ratio (i/ii) is from 5/95 to 80/20.

The binder resin preferably has a peak molecular weight of from 1,000 to 10,000.

The toner preferably has a glass transition temperature of from 40 to 70° C.

It is preferable that the toner further includes an external additive which is present on the surface of the toner particles. The external additive is preferably selected from hydrophobized silica and hydrophobized titanium oxide.

As another aspect of the present invention, a developer is provided which includes the toner mentioned above and a carrier.

As yet another aspect of the present invention, an image forming apparatus is provided which includes at least an image bearing member such as photoreceptors configured to bear an electrostatic latent image thereon, a developing device configured to develop the electrostatic latent image with a developer including the toner of the present invention to form a toner image on the image bearing member, a transferring device configured to transfer the toner image onto a receiving material and a cleaning device configured to clean the surface of the image bearing member.

As a further aspect of the present invention, a process cartridge for an image forming apparatus is provided which includes:

at least an image bearing member configured to bear an electrostatic latent image thereon; and a developing device configured to develop the electrostatic latent image with a developer including the toner mentioned above to form a toner image on the image bearing member.

The process cartridge may include a charger configured to charge the image bearing member; a cleaner configured to clean a surface of the image bearing member; and other devices mentioned above for use in the image forming apparatus of the present invention.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the toner of the present invention will be explained in detail referring to drawings.

Figure 1A:
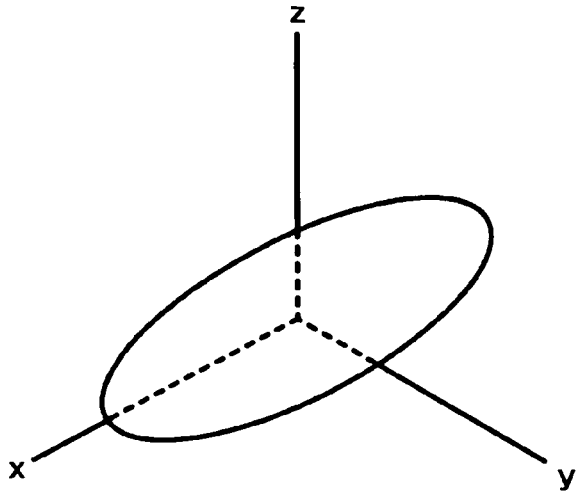
FIGS. 1A to 1C are schematic views illustrating an example of a particle of the toner of the present invention.
Figure 1B:
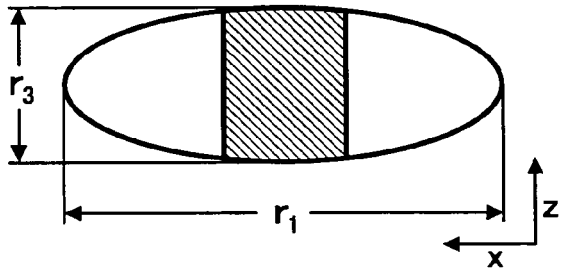
Figure 1C:
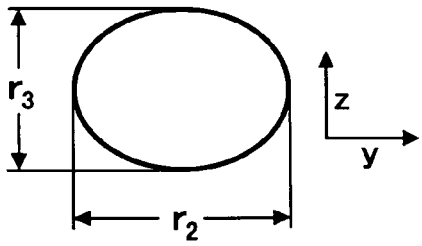

The toner of the present invention preferably has a spindle form and a volume average particle diameter (Dv) of from 3 to 8 μm. FIGS. 1A–1C are schematic views illustrating an example of a particle of the toner of the present invention. FIG. 1A is a perspective view of the toner particle, and FIGS. 1B and 1C are cross sections of the toner particle.

In FIG. 1A, the toner particle has a major axis particle diameter r1 in an X direction, a minor axis particle diameter r2 in a Y direction and a thickness r3 in a Z direction. In this regard, the following relationship is satisfied:

$$r1 > r2 \geqq r3.$$

Since the larger the volume average particle diameter (Dv) of a toner, the better the fine dot (line) reproducibility of the toner images, the volume average particle diameter (Dv) is preferably not greater than 8 μm. However, the smaller the volume average particle diameter (Dv) of a toner, the worse the cleanabililty of the toner, and therefore the volume average particle diameter (Dv) is preferably not less than 3 μm. In particular, when toner particles having a particle diameter not greater than 2 μm are included in the toner in an amount not less than 20%, such fine toner particles tend to be present on the surface of the carrier and the developing roller used and thereby the other toner particles are insufficiently contacted and frictionized with the carrier and the developing roller, resulting in increase of the amount of reversely charge toner particles. Therefore, background development occurs and image qualities deteriorate.

In addition, the ratio (Dv/Dn) (i.e., an index of particle diameter distribution) of the volume average particle diameter (Dv) to the number average particle diameter (Dn) of the toner is preferably from 1.00 to 1.40. When the toner has a sharp particle diameter distribution, the toner particles have uniform charge quantities (i.e., the toner has a sharp charge quantity distribution), and thereby occurrence of background development can be prevented.

When the ratio (Dv/Dn) is too large, the toner has broad charge quantity distribution, and thereby it becomes difficult to produce high quality images.

The particle diameters Dv and Dn of a toner can be measured by a COULTER COUNTER MULTISIZER (manufactured by Beckman Coulter, Inc.) using an aperture having an opening with 50 μm. The average particle diameters Dv and Dn are determined by measuring 5,000 particles and averaging the data.

The shape of the toner particles can be controlled by controlling the manufacturing conditions. When a toner is prepared by a dry pulverization method, the surface of the resultant toner particles are roughened (i.e., the surface has projected portions and recessed portions), namely, the toner particles have irregular forms. By subjecting such toner particles as prepared by a pulverization method to a mechanical treatment or a heat treatment, the shape of the toner particles can be changed to a form near the spherical form.

Toner particles prepared by a wet polymerization method such as suspension polymerization methods and emulsion polymerization methods have smooth surface and a form near the spherical form. In addition, it is possible to form toner particles having an irregular form like potato by at first preparing fine toner particles and then agglomerating the fine toner particles. Further, it is possible to form toner particles having an ellipse form or a flat form by preparing toner particles by a polymerization method and applying a shear force to the toner particles in process of the polymerization reaction.

With respect to the particle form, the toner of the present invention preferably satisfies the following relationship:

$$0.5 \leqq (r2/r1) \leqq 0.8 \text{ and } 0.7 \leqq (r3/r2) \leqq 1.0.$$

When the ratio (r2/r1) is too small, the toner has a form far away from the spherical form, and therefore the toner has good cleanability, but the dot reproducibility and transfer efficiency deteriorate, resulting in deterioration of image qualities. In contrast, when the ration (r2/r1) is too large, the toner has a form near the spherical form and therefore the cleaning problem tends to occur, particularly, under low temperature and low humidity conditions.

When the ratio (r3/r2) is too small, the toner has a flat form and therefore the toner does not cause the fogging problem similarly to a toner having an irregular form. However, such a toner is inferior to a spherical toner in transferability. In particular, when the ratio (r3/r2) is 1.0, the toner easily rolls while the major axis is the rotation axis. The toner of the present invention preferably has a spindle form which is different from the spherical, irregular and flat forms, and has all the advantages of the spherical-, irregular- and flat-form toners, i.e., good chargeability, good dot reproducibility, high transferability, good fogging-preventing ability and good cleanability.

Since the toner of the present invention has a spindle form, the toner has such a particle form as to relatively easily roll in one direction compared to other directions when the toner is located on a two-dimensional X-Y plane. Specifically, referring to FIG. 1A, particles of the toner relatively easily roll in a direction such that the major axis is a rotation axis (i.e., in the Y direction) compared to other directions, for example, a direction such that the minor axis is a rotation axis (i.e., in the X direction).

In contrast, a spherical toner easily rolls in all directions (and therefore the cleaning problem occurs), and the irregular- and flat-form toners hardly roll in all directions.

Figure 2A:
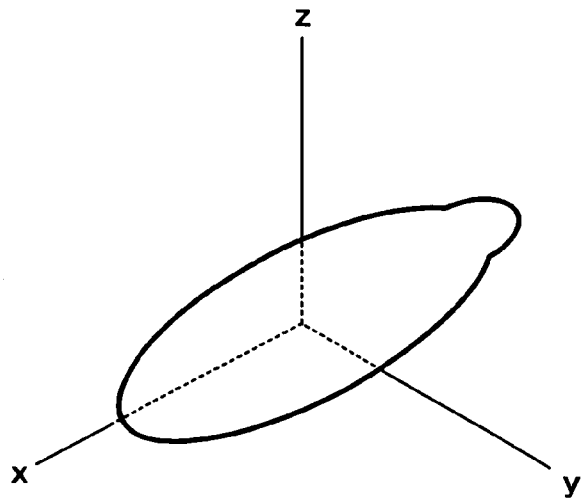
FIGS. 2A to 2C are schematic views illustrating another example of a particle of the toner of the present invention.
Figure 2B:
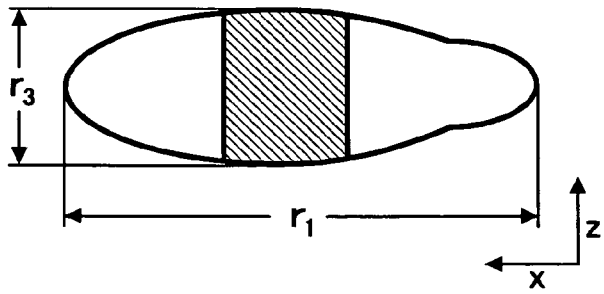
Figure 2C:
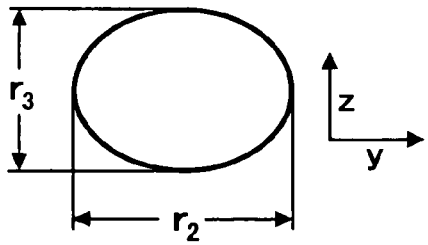

All or some of particles of the toner of the present invention may have a projection at an end portion thereof in the major axis direction as illustrated in FIG. 2. FIG. 2A is a perspective view of a toner particle having a projection at an end thereof. FIGS. 2B and 2C are cross sections of the particle illustrated in FIG. 2A.

When the toner particle has such a projection, the center of gravity of the toner particle deviates from the center of the spindle portion of the toner particle. Therefore, the toner particle makes precession movement even when the toner particle rolls while the major axis is a rotation axis. Thus, the toner of the present invention has different rolling properties in X and Y directions when the toner is located on a two-dimensional X-Y plane. In addition, even when the toner particles roll, the toner particles make irregular movement due to projections formed on an end of the toner particles. Therefore, the movement of particles of the toner of the present invention is different from those of spherical-, flat- and irregular-form toners.

Then the toner of the present invention having a spindle form will be explained in detail while comparing the toner with toners having other forms.

Toners prepared by wet polymerization methods have poor cleaninability. For example, even when such toners have an average particle diameter of about 10 μm, the cleaning problem mentioned above often occurs if a blade is used as a cleaner. This is because the surface of the toner particles is smooth and thereby the toner tends to roll on the surface of a photoreceptor and invades into a gap between the cleaning blade and the photoreceptor. In addition, there are no projections and recessed portions on the surface of such spherical toners, and therefore all the particles of the external additive (such as silica) included in the toner are contacted with the surface of a photoreceptor.

A large amount of external additive (such as silica) is typically added to a spherical toner, but the external additive tends to be embedded into the toner, resulting in occurrence of fusion of the toner particles and thereby undesired streak images are formed.

In contrast, toners having an irregular form have many projections and recessed portions on the surface thereof. Therefore the toner particles hardly roll on the surface of a photoreceptor, and thereby the toner particles on the surface of a photoreceptor can be easily removed by a cleaning blade.

A toner having a spindle form easily rolls in only one direction. Namely, the toner rolls while its major axis (i.e., the X direction in FIG. 1A) is a rotation axis. Therefore the toner has good cleanability. In addition, when the toner has a projection at an end thereof in its major axis direction, the center of gravity deviates from the center of the spindle portion, and thereby the toner particles make irregular movement, resulting in further improvement of the cleanability of the toner.

In addition, when a toner image is transferred by an electrostatic transfer method, the toner image is well transferred on a receiving material if the toner is a spherical toner. This is because spherical toner particles have good fluidity and small adhesion to each other or to a photoreceptor because of having smooth surface, and thereby the toner particles are easily influenced by electric forces. Therefore a toner image can be faithfully transferred along the electric lines of force. However, when a receiving material is separated from a photoreceptor after the toner image transfer process, a high electric field is generated between the receiving material and the photoreceptor (so-called "a burst phenomenon"). Therefore, the toner image on the receiving material tends to be scattered, resulting in formation of fogging. In this case, when the toner image is formed of spherical toner particles, the toner image is easily scattered, and thereby a serious fogging problem is caused, resulting in deterioration of the image qualities.

Toner particles having an irregular form or a flat form are not so strongly influenced by electric force as the spherical toner particles. Namely, such toner particles have a low transfer rate. However, the toner particles have large adhesion to each other, and thereby a toner image transferred on a receiving material is hardly damaged by an external force. Therefore, the fogging problem due to the burst phenomenon can be avoided.

The toner of the present invention having a spindle form has a proper fluidity because of having a good rolling property in one direction, and has a smooth surface. Therefore, the toner is easily influenced by electric force, and thereby the toner image can be faithfully transferred along the electric lines of force at a high transfer rate. In addition, the toner has only one rolling direction, the toner hardly causes the fogging problem due to the burst phenomenon because the toner particles are hardly scattered. Therefore, good images can be produced.

When an electrostatic latent image is developed with a toner by an electrostatic developing method, the latent image is faithfully developed along the electric lines of force if the toner is formed of spherical toner particles because the toner easily influenced by electric force. In particular, a fine latent image is developed with a toner and the toner image is transferred, the toner image has good dot reproducibility if the toner is a spherical toner. This is because spherical toner particles are densely arranged in the toner image.

However, a latent image is developed by a contact developing method, the toner adhered to the latent image is easily moved by further rubbed with a magnet brush or a developing roller, and thereby the fogging problem occurs, resulting in deterioration of the image qualities.

In contrast, toner particles having an irregular form or a flat form have poor fluidity, and therefore the toner particles cannot be moved along the electric force of an electrostatic latent image, and thereby the toner particles are not orderly arranged on the latent image. Namely, the resultant toner image has poor fine dot reproducibility.

The toner of the present invention having a spindle form having a properly controlled fluidity and is adhered to an electrostatic latent image along the electric lines of force. Therefore, the latent image can be faithfully developed by the toner, resulting in formation of a toner image having good dot reproduciblity. In addition, the toner in the developed image is hardly moved by a magnet brush and a developing roller, and thereby high quality images without undesired images such as fogging can be produced.

The toner of the present invention preferably satisfies the following relationships:

$5\ \mu m \leqq$ average of major axis particle diameter $r1 \leqq 9\ \mu m$;

$2\ \mu m \leqq$ average of minor axis particle diameter $r2 \leqq 6\ \mu m$;

$2\ \mu m \leqq$ average of thickness $r3 \leqq 6\ \mu m$; and $r1 > r2 \geqq r3$.

When the average major axis particle diameter r1 is too small, the cleanability of the toner deteriorates, and it becomes difficult to perform cleaning with a cleaning blade. In contrast, when the average major axis particle diameter is too large, there is a possibility that the toner is pulverized when the toner is mixed with a magnetic carrier. When the thus produced fine toner particles are adhered to a magnetic carrier, other toner particles are prevented from being frictionized by the carrier, resulting in broadening of the charge quantity distribution of the toner. Therefore, background development is caused. The above-mentioned pulverizing is performed by a developing roller as well as a magnetic carrier.

When the average minor axis particle diameter r2 is too small, the resultant toner has poor fine dot reproducibility and low transfer rate (i.e., poor transferability). In addition, such a toner tends to be easily pulverized when mixed with a magnetic carrier. In contrast, when the average minor axis particle diameter r2 is too large, the cleanability of the toner deteriorates and it becomes difficult to perform cleaning with a cleaning blade.

When the thickness r3 is less than 2 μm, the toner tends to be easily pulverized when mixed with a magnetic carrier. When the thickness is greater than 6 μm, the toner has a form near the spherical form and therefore the fogging problem tends to occur when the toner is used for electrostatic developing methods and electrostatic transferring methods.

In addition, the toner of the present invention preferably satisfies the following relationships:

(1) Standard deviation S1 of average major axis particle diameter r1: not greater than 2.0 μm;

(2) Standard deviation S2 of average minor axis particle diameter r2: not greater than 1.5 μm; and (3) Standard deviation S3 of thickness r3: not greater than 1.5 μm.

When the standard deviations S1, S2 and S3 are too large (i.e., the toner has variation in it form), there are many variations in the behavior of the toner during developing, transferring and cleaning processes, resulting in deterioration of the image qualities.

It is preferable for the toner of the present invention to include toner particles having a thickness not greater than 3 μm in an amount not greater than 30% by weight based on the total weight of the toner. When the content of toner particles having a thickness not greater than 3 μm is too high, the toner is similar to a flat toner, and therefore fine dot reproducibility and transferability of the toner deteriorate.

The above-mentioned size factors (i.e., r1, r2, r3, S1, S2 and S3) of toner particles can be determined by observing the toner particles with a scanning electron microscope while the viewing angle is changed.

The toner of the present invention preferably has a form factor SF-2 of from 100 to 190. The form factor represents the degree of the asperity of the surface of a toner particle, and is defined by the following equation (1):

$$SF\text{-}2=\{(\mathrm{PERI})^2/\mathrm{AREA}\}\times(100\pi/4) \quad (1)$$

wherein PERI and AREA represent the peripheral length and area of a toner particle, respectively.

When the form factor is 100, the toner particle has no asperity on the surface thereof. Toner having a large form factor have a roughened surface, and thereby the toner cannot be uniformly charged, resulting in deterioration of the image qualities (i.e., occurrence of background development). Therefore the form factor is preferably not greater than 190.

The form factor SF-2 can be determined by the following method:

(1) toner particles are observed with a FE-SEM S-800 manufactured by Hitachi Ltd. with magnification power of 500; and (2) 100 pieces of the particle images caught by the SEM, which are randomly sampled, are analyzed with an image analyzer LUZEX III manufactured by Nireco Corp. using an interface.

It is preferable that a material (hereinafter this material is referred to as a protective material) which protects the surface of the toner of the present invention is fixed on the surface of the toner. As mentioned above, the toner of the present invention has a spindle form and thereby the toner particles easily roll while the major axis (i.e., the X axis in FIG. 1A) is a rotation axis. Therefore, the toner particles roll on the carrier, the developing roller and the photoreceptor while the major axis is a rotation axis. Therefore, the portion of a toner particle illustrated as a shadow area in FIG. 1B tends to be damaged, specifically, a problem occurs in that a soft material such as waxes exude from the portion, and thereby the carrier, developing roller and photoreceptor are contaminated with the soft material. Therefore it is preferable to protect the surface of the toner.

Specific examples of the protective material include hard materials, for example, carbides such as boron carbide, silicon carbide, titanium carbide, zirconium carbide and tungsten carbide; and nitrides such as titanium nitride, boron nitride and zirconium nitride. The protective material is preferably fixed on the surface of the toner to prevent the protective material from releasing from the toner surface and to prevent the released protective material from adhering to or damaging the surface of the carrier, developing roller, photoreceptor and charger. Therefore, the protective material is preferably fixed on the toner surface upon application of strong external force using a mixer, etc.

In addition, charge controlling agents can be used as the protective material. In this case, the charge controlling agents not only protect the toner surface but also impart good friction chargeability to the toner. The charge controlling agents can be used in combination with the hard materials mentioned above.

It is preferable that a protective material is fixed on the toner surface by a mechanical or heat treatment in the atmosphere. When the toner is prepared by a wet polymerization process, it is also preferable to fix a protective material on the toner surface by performing a electrochemical or mechanical treatment in a solvent during the wet polymerization process.

Specifically, the following fixing methods can be preferably used:

(1) Toner particles and a protective material are mixed in a container using a mixer having a rotor. When using this method, it is preferable that toner particles and a protective material are mixed in a container having no projection therein while a rotor is rotated at a high speed, to fix the protective material on the toner surface.

(2) Toner particles and a protective material are preliminarily mixed. Then the mixture is sprayed into a container by an atomizer or the like using hot air, followed by cooling. Thus, the protective material is fixed on a melted surface of the toner particles.

(3) A method in which a protective material is adsorbed on the surface of toner particles in a solvent can also be used.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and it compounds, tungsten and its compounds, fluorine-containing activators, metal salts of salicylic acid, metal salts of salicylic acid derivatives, etc.

Specific examples of the charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; metal salts (such as Cr, Zn, Fe, Zr, and Al) of salicylic acid and their complexes and complex salts; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner is preferably from 0.2 to 2.0% by weight, preferably from 0.3 to 1.5% by weight and more preferably from 0.4 to 1.0% by weight, based on the total weight of the toner. The charge controlling agent can be fixed on the toner surface by being mixed with toner particles while agitating. Whether a charge controlling agent is present on the surface can be determined by X-ray photoelectron spectroscopy. It is preferable to use a charge controlling agent having the same charge polarity as that of the toner particles. By using such a charge controlling agent, the resultant toner has not only quick charging property but also a narrow charge quantity distribution, and thereby high quality images can be produced without causing background development even after toner is replenished.

When the content of the charge controlling agent is too high, the amount of toner particles having an opposite polarity increases due to friction charging of the toner particles themselves, resulting in occurrence of background development. In addition, when toner particles have a large charge quantity, the fluidity of the toner deteriorates, and thereby the mixing property of the toner with a carrier deteriorates. In contrast, the content of the charge controlling agent is too low, weakly charged toner particles increase, resulting in occurrence of background development. In addition, when the toner is used for a long period of time, the chargeability of the toner deteriorates, resulting in occurrence of background development and deterioration of the image qualities.

The toner of the present invention preferably has a charge quantity of from 15 to 40 μC/g (in absolute value). When the charge quantity is too low, the adhesion of the toner with a carrier increases and thereby a large amount of toner particles are adhered to an electrostatic latent image even at a low electric field, resulting in formation of images having poor image qualities. In addition, images having good half toner reproducibility cannot be produced. Further, the amount of toner particles having opposite charge polarity increases, background development is caused and the image qualities deteriorate. In contrast, when the charge quantity is too large, the adhesion of the toner particles to the magnetic carrier increases, and thereby the amount of the toner in a developed toner image decreases, resulting in decrease of the image density.

In addition, the half width of the charge quantity distribution curve of the toner of the present invention is preferably from 0.5 to 4.0 fC/μm. When the half width is too small, the particle diameter distribution of the toner has to be narrowed. However, it is difficult to manufacture such a toner. In contrast, when the half width is too large, the amount toner particles having an opposite polarity increases and thereby the image quality of the toner deteriorates (i.e., background development is caused).

The toner of the present invention having a spindle form has a surface which is relatively smooth compared to that of toners having an irregular or flat form because the toner surface is similar to that of the spherical toners, and has good charging properties such that charging quantity is relatively uniform and charge quantity distribution is relatively narrow compared to those of toners having an irregular or flat form. In addition, since the toner has good mixability with a carrier, the toner has good charge rising property, which is an important requisite of a toner for use in a developing method in which developing is performed while replenishing the toner. Therefore occurrence of background development can be avoided. Needless to say, the same is true for a one component developer including the toner of the present invention.

The charge quantity of a toner can be determined by a blow-off powder charge measuring instrument TB-200 (from Toshiba Chemical Co., Ltd.). The charge quantity distribution (i.e., Q/d distribution, fC/μm) is measured by a charge quantity distribution measuring instrument E-SPART ANALYZER (from Hosokawa Micron Corp.). The half width can be determined by the Q/d distribution Then the constitution of the toner and the materials constituting the toner will be explained.

The toner of the present invention includes at least a binder resin and a colorant, and optionally includes a release agent, wherein a charge controlling agent is preferably fixed on the surface of the toner particles and the release agent is preferably present in a surface portion of the toner particles. It is preferable that organic fine particles are also fixed on the surface of the toner particles together with the charge controlling agent and in addition an external additive is added to the toner particles so as to be present on the surface of the toner particles.

In the toner of the present invention, a modified polyester resin is preferably used as a toner binder.

The modified polyester resin is defined as polyester resins which include a bonding group other than the ester bonding, and resins in which a resin unit other than polyester resin units is bonded with polyester units with a covalent bonding and an ionic bonding. For example, the following polyester resins can be preferably used as the modified polyester:

(1) a functional group such as isocyanate groups which can react with an acid group and a hydroxyl group is incorporated in a polyester resin; and (2) the polyester resin is further reacted with a compound having an active hydrogen so that the end portion is modified.

Suitable modified polyester resins include reaction products of a polyester prepolymer (A) having an isocyanate group with an amine (B).

As the polyester prepolymer (A), for example, compounds prepared by reacting a polycondensation product of a polyol (1) and a polycarboxylic acid (2), which has a group having an active hydrogen, with a polyisocyanate (3) are used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. Preferably diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide, and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids include dicarboxylic acids (2-1) and polycarboxylic acids (2-2) having three or more carboxyl groups. Preferably dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more carboxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphaticpolyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the unit obtained from a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby hot offset resistance deteriorate.

Specific examples of the amines (B) include diamines (B1), polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures of a diamine with a small amount of a polyamine (B2) are preferable.

The molecular weight of the urea-modified polyesters can be controlled using an elongation anticatalyst, if desired. Specific examples of the elongation anticatalyst include monoamines (e.g., diethyle amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters can be prepared, for example, by a method such as one-shot methods or prepolymer methods. The weight average molecular weight of the urea-modified polyesters is not less than 10,000, preferably from 15,000 to 10,000,000 and more preferably from 20,000 to 1,000,000. In addition, the peak molecular weight of the urea-modified polyesters is preferably from 1,000 to 10,000. In addition, the peak molecular weight is preferably from 1,000 to 10,000. When the peak molecular weight is too low, the hot offset resistance of the resultant toner deteriorates. In contrast, when the peak molecular weight is too high, the fixability of the toner deteriorates. In addition, it takes a long timer to perform granulizing and pulverizing, resulting in increase of manufacturing costs.

The number average molecular weight of the urea-modified polyester resin (i) is not particularly limited if an unmodified polyester resin (ii) is used in combination. Specifically, the weight average molecular weight of the urea-modified polyester resin (i) is mainly controlled rather than the number average molecular weight. When the urea-modified polyester resin (i) is used alone, the number average molecular weight of the resin (i) is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low gloss.

It is preferable to use a combination of a urea-modified polyester resin with an unmodified polyester resin as the binder resin. By using a combination of a urea-modified polyester resin with an unmodified polyester resin, the low temperature fixability of the toner can be improved and in addition the toner can produce color images having a high gloss.

Suitable unmodified polyester resins include polycondensation products of a polyol with a polycarboxylic acid. Specific examples of the polyol and polycarboxylic acid are mentioned above for use in the modified polyester resins. In addition, specific examples of the suitable polyol and polycarboxylic acid are also mentioned above.

In addition, as the unmodified polyester resins, polyester resins modified by a bonding (such as urethane bonding) other than a urea bonding, can also be used as well as the unmodified polyester resins mentioned above.

When a combination of a modified polyester resin with an unmodified polyester resin is used as the binder resin, it is preferable that the modified polyester resin at least partially mixes with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 60/40, preferably from 5/95 to 30/70, more preferably from 5/95 to 25/75, and even more preferably from 7/93 to 20/80. When the addition amount of the modified polyester resin is too small, the hot offset resistance of the toner deteriorates and in addition, it is impossible to achieve a good combination of high-temperature preservability and low temperature fixability.

The peak molecular weight of the unmodified polyester resins is from 1,000 to 10,000, preferably from 2,000 to 8,000 and more preferably from 2,000 to 5,000. When the peak molecular weight is too low, the high-temperature preservability deteriorates. When the peak molecular weight is too high, the low temperature fixability deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor preservability and poor low temperature fixability.

The unmodified polyester resin (ii) preferably has an acid value of from 1 to 5 mgKOH/g, and more preferably from 2 to 4 mgKOH/g. When a wax having a high acid value is used as a release agent, the binder resin preferably has a low acid value to impart good chargeability and high resistivity to the toner.

The binder resin in the toner of the present invention preferably has a glass transition temperature (Tg) of from 40 to 70° C. and more preferably from 55 to 65° C. When the glass transition temperature is too low, the preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

In the toner of the present invention, it is preferable that a release agent is present in a surface portion. It is preferable that the release agent is present in a surface portion of toner particles in an amount not less than 80% by number based on total particles of the release agent included in the toner particles. In such a toner, a sufficient amount of releasing agent can exude from the surface of the toner particles when toner images are fixed. Therefore, this toner can be used for oil-less fixing methods. In addition, even when this toner is used for an oil-less fixing method, the toner can produce (color) images having high gloss. Since the release agent is hardly present on the toner surface, the toner has good durability and preservability.

In addition, since the amount of the release agent present on the surface of the toner particles is little, the toner has good durability and good preservability. In the toner of the present invention, the release agent causes a negative adsorption on the polar group in the modified polyester resin at the interface therebetween (i.e., the release agent is adsorbed on the polar group but is not mixed with the polar group), and thereby the release agent can be stably dispersed in the toner particles. In particular, when a toner is prepared by dissolving or dispersing a toner composition in an organic solvent, and then dispersing the toner composition liquid in an aqueous medium, the bonding portion of the binder resin, which has a high polarity, migrates to the surface portion of toner particles because of having fair affinity for water, and thereby the toner particles can be prevented from exposing the release agent.

Specifically, when the ratio of the release agent included in the cross section of a surface portion (from 0 to 1 μm in depth) of toner particles is preferably from 5 to 40% based on total area of the cross section of the surface portion. When the ratio is to small, the toner has poor offset resistance. In contrast, when the content is too large, the toner has poor heat resistance and durability. In this regard, the surface portion is defined as a surface portion having a thickness of 1 μm (i.e., a portion having a depth up to 1 μm from the surface of the toner particles).

The release agent dispersed in the toner particles preferably has a particle diameter distribution such that particles having a particle diameter of from 0.1 to 3 μm are present in an amount not less than 70% by number, and more preferably particles having a particle diameter of from 1 to 2 μm are present in an amount not less than 70% by number. When the content of fine particles is too high, good release property cannot be imparted to the toner. In contrast, when the content of large particles is too high, the toner has poor fluidity because the release agents agglomerate, resulting in formation of a film of the release agent on a photoreceptor, etc. In addition, when such a toner is used as a color toner, the toner has poor color reproducibility and the toner images have a low gloss.

In order to control the dispersion state of the release agent in toner particles, it is important that the release agent is dispersed in a medium while the dispersion energy is properly controlled and a proper dispersant is added thereto.

The release agent preferably has an acid value not greater than 5 mgKOH/g because a release agent having too high an acid value has poor releasability. From this point of view, carnauba waxes which are subjected to a free-fatty-acid removing treatment, rice waxes, montan ester waxes and ester waxes are preferably used as the release agent in the toner of the present invention.

In addition, it is preferable that an organic particulate material is fixed on the surface of the toner of the present invention to exude the release agent present in a surface portion from the surface of the toner only when the toner is heated to be fixed on a receiving material. When the toner has such a constitution, a problem in that the release agent included in the surface portion exudes from the surface of the toner when the toner is agitated in a developing device, resulting in deterioration of the chargeability of the toner, can be avoided.

In order to fix an organic particulate material on the surface of the toner, the following methods are preferably used, but the fixing method is not limited thereto:

(1) a particulate resin is adhered to the surface of toner particles and then heat is applied to fix the particulate resin on the surface of the toner; or (2) a particulate resin is fixed on toner particles in a liquid.

The toner of the present invention preferably includes an external additive to improve the fluidity, developability, chargeability thereof.

Inorganic fine particles are typically used as an external additive. Suitable inorganic fine particles include inorganic particulate materials having a primary particle diameter of from 5 nm to 2 μm, and preferably from 5 nm to 500 nm. The surface area of the inorganic particulate materials is preferably from 20 to 500 $m^2/g$ when measured by a BET method.

The content of the inorganic particulate material in the toner is preferably from 0.01% to 5.0% by weight, and more preferably from 0.01% to 2.0% by weight, based on the total weight of the toner.

Specific examples of such inorganic particulate materials include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particulate resins prepared by a method such as soap-free emulsion polymerization methods, suspension polymerization methods and dispersion polymerization methods can also be used as the external additive. Specific examples of the particulate resins include particles of polymers such as polystyrene resins and (meth)acrylate copolymers; polycondensation polymers such as silicone resins, benzoguanamine resins and nylons; and thermosetting polymers.

The external additive is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

In addition, a cleanability improving agent can be included in the toner to impart good cleaning property to the toner, i.e., to easily remove toner particles, which remain on the surface of an image bearing member such as a photoreceptor even after a toner image is transferred, from the image bearing member. Specific examples of such a cleanability improving agent include fatty acids and their metal salts such as zinc stearate, and calcium stearate; and particulate polymers such as polymethyl methacrylate and polystyrene, which are manufactured by a method such as soap-free emulsion polymerization methods. The particulate polymers preferably has a volume average particle diameter of from 0.01 μm to 1 μm.

The toner of the present invention includes a colorant as an essential material.

Suitable colorants for use in the toner of the present invention include known dyes and pigments. Specific examples of the colorants include carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthabocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flashing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Then the method of manufacturing the toner of the present invention will be explained.

Suitable aqueous media for use in the toner manufacturing method of the present invention include water and mixtures of water and a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

In the present invention, toner particles can be prepared, for example, as follows:

(1) a composition including a prepolymer (A) having an isocyanate group (or a modified polyester resin, and optionally together with an unmodified polyester resin), a colorant and additives such as a release agent and a charge controlling agent is dissolved/dispersed in an organic solvent to prepare a composition liquid (i.e., an oil phase liquid);

(2) the composition liquid is mixed with an amine (B) when a prepolymer is used;

(3) the composition liquid is dispersed in the aqueous phase liquid while a shearing force is applied thereto to prepare an emulsion having a desired particle diameter (the colorant, release agent and amine can be mixed in this step);

(4) the emulsion is optionally heated to perform a urea reaction of the prepolymer (A) with the amine (B);

(5) the solvents are removed from the reaction product to obtain particles; and (6) the particles are washed and dried, resulting in formation of toner particles in which the particulate material is adhered to the surface of the toner particles while embedded thereinto.

Before the composition is dissolved/dispersed in an organic solvent, toner constituents such as the colorant, release agent and charge controlling agent are preferably mixed such that the components are finely dispersed in the composition liquid.

The toner constituents other than the binder resin, such as colorants, release agents and charge controlling agents, are not necessarily mixed with the binder resin when the toner constituents are dissolved or dispersed, and can be added, for example, after the resin particles are formed. For example, resin particles are dyed with a colorant using a known dyeing method.

The method for preparing the emulsion is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes for a batch production method. The temperature in the dispersion process is typically from 0 to 150° C. (under pressure), and preferably from 40 to 98° C. When the dispersion is performed at a relatively high temperature, the dispersion including a prepolymer (A) or a urea-modified polyester resin has a low viscosity and therefore dispersion can be easily performed.

When the emulsion is prepared, the weight ratio (T/M) of the composition (T) (including a prepolymer (A) or modified polyester resin) to the aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant toner particles do not have a desired particle diameter. In contrast, when the ratio is too small, the manufacturing costs increase.

When the emulsion is prepared, a dispersant can be preferably used so that particles in the emulsion have a sharp particle diameter distribution and the emulsion has good dispersion stability.

Specific examples of the dispersants which are used for emulsifying an oil phase liquid, in which a toner composition is dissolved or dispersed, in an aqueous phase liquid, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a dispersion having good dispersibility can be prepared even when the amount of the surfactant is small. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6–C11)oxy}-1-alkyl(C3–C4)sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10)sulfoneamidepropyltrimethylammonium salts, salts of perfluoroalkyl(C6–C10) -N-ethylsulfonyl glycin, monoperfluoroalkyl(C6–C16)ethylphosphates, etc.

Specific examples of the marketed products of such surfactants include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group, which can disperse an oil phase liquid including toner constituents in water, include primary, secondary and tertiary aliphatic amines having a fluoroalkyl group, aliphatic quaternary ammonium salts such as perfluoroalkyl(C6–C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, it is confirmed that inorganic dispersants, which are hardly soluble in water, such as tricalcium phosphate, calcium carbonate, titanium oxide, colloidal silica, and hydroxyapatite can also be used.

In addition, particulate polymers have the same effects as the inorganic dispersants. Specific examples of the particulate polymers include particulate methyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Chemical Co., Ltd.)

Further, it is possible to stably disperse (emulsify) a toner composition in water using a combination of an inorganic dispersant and/or a particulate resin, and a polymeric protection colloid. Specific examples of such protection colloids include polymers and copolymers obtained from monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When the organic solvent is removed from the thus prepared emulsion (i.e., the reaction product), the organic solvent is removed under normal pressure or reduced pressure after the elongation and/or crosslinking reaction of a modified polyester (or a prepolymer) with an amine.

When compounds such as calcium phosphate which are soluble in an acid or alkali are used as a dispersion stabilizer, the resultant particles are preferably added into an acid such as hydrochloric acid and then washed with water to remove calcium phosphate from the particles. In addition, calcium phosphate can be removed using a zymolytic method. When a dispersant is used for preparing the emulsion, the dispersant may be removed or may not be removed from the resultant particles.

In addition, toner particles having a spindle form can be prepared, for example, by agitating the emulsion such that the emulsion has a stream line flow while heating, and then strongly agitating at a predetermined temperature range to remove the solvent from the emulsion.

The toner particle form can be controlled by changing the solvent removing conditions. In order to prepare toner particles having a desired particle form, a proper dispersant is used and in addition the solvent-removing conditions have to be properly controlled. When a recessed portion (or asperity) having a proper size is formed on toner particles, the content of the solid components in the oil phase of the emulsion is preferably controlled to be from 5 to 50% by weight based on total weight of the oil phase. In addition, the solvent-removing temperature is preferably controlled to be from 10 to 50° C., and the solvent-removing time is preferably within 30 minutes. When the solvent-removing treatment is performed under such conditions, the solvent in the oil phase is rapidly evaporated and thereby the temperature of the oil phase decreases, resulting in formation of a hard oil phase and shrinkage of the oil phase. Therefore, toner particles having a recessed portion (or asperity) can be prepared.

When the content of the solid components in the oil phase is too high (i.e., the amount of solvent in the oil phase is small), toner particles having a desired particle form are hardly obtained. In contrast, when the content of the solid components in the oil phase is too low, the productivity of the toner particles seriously deteriorates. When the solvent-removing time is too long, spherical particles tend to be obtained.

The solvent-removing conditions are not limited to the above-mentioned conditions, and it is preferable to optimize, for example, the temperature and solvent removing time.

When an aqueous dispersion or emulsion is prepared, a solvent which can dissolve the urea-modified polyester or prepolymer (A) used is preferably used because the resultant particles have a sharp particle diameter distribution. The solvent is preferably volatile and has a boiling point lower than 100° C. because of easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100 and more preferably from 25 to 70 parts by weight, per 100 parts by weight of the polyester (the prepolymer (A) or the urea-modified polyester) used.

The reaction time of elongation and/or crosslinking is determined depending on the reacting property of the prepolymer (A) and the amine (B) used, but the reaction time is generally from 10 minutes to 40 hours, and preferably 2 hours to 24 hours. The reaction temperature is generally from 0 to 150° C. and preferably from 40 to 98° C. In addition, a known catalyst can optionally be used. Specific examples of the catalyst include dibutyltin laurate and dioctyltin laurate. The elongation and/or crosslinking of a polyester resin is performed using an amine (B).

It is preferable in the present invention to perform a shape controlling operation before removing the solvent from the emulsion which has been subjected to the elongation and/or crosslinking reaction. Specifically, the shape controlling operation is performed by strongly agitating the emulsion in a container having no projections (such as baffle plates) on the inside surface thereof at a temperature of from 30 to 50° C. After it is confirmed that the resultant particles have the desired spindle form, the emulsion is subjected to the solvent-removing treatment at a temperature of from 10 to 50° C. Thus, toner particles having a desired spindle form can be prepared.

The shape controlling method is not limited to the above-mentioned operation, but it is preferable to apply a high shearing force to the emulsion in a container after the elongation/crosslinking reaction. In this case, it is preferable that the emulsion has a low viscosity to prepare toner particles having a desired spindle form. Namely, the physical properties such as volume average particle diameter (Dv), number average particle diameter (Dn), and ratios (Dv/Dn), (r2/r1) and (r3/r2) can be controlled by changing the conditions such as viscosities of the water phase and oil phase, properties of the particulate resin and additives added, etc.

Then the developer of the present invention will be explained in detail.

The toner of the present invention can be used for a two-component developer in which the toner is mixed with a magnetic carrier. The weight ratio (T/C) of the toner (T) to a carrier (C) is preferably from 1/100 to 10/100.

Suitable carriers for use in the two component developer include known carrier materials such as iron powders, ferrite powders, magnetite powders, and magnetic resin carriers, which have a particle diameter of from about 20 μm to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the coating resin. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

The toner of the present invention can also be used as a one-component magnetic developer or a one-component non-magnetic developer, which does not use a carrier.

Then the image forming apparatus of the present invention will be explained referring to FIGS. 3 and 4.

Figure 3:
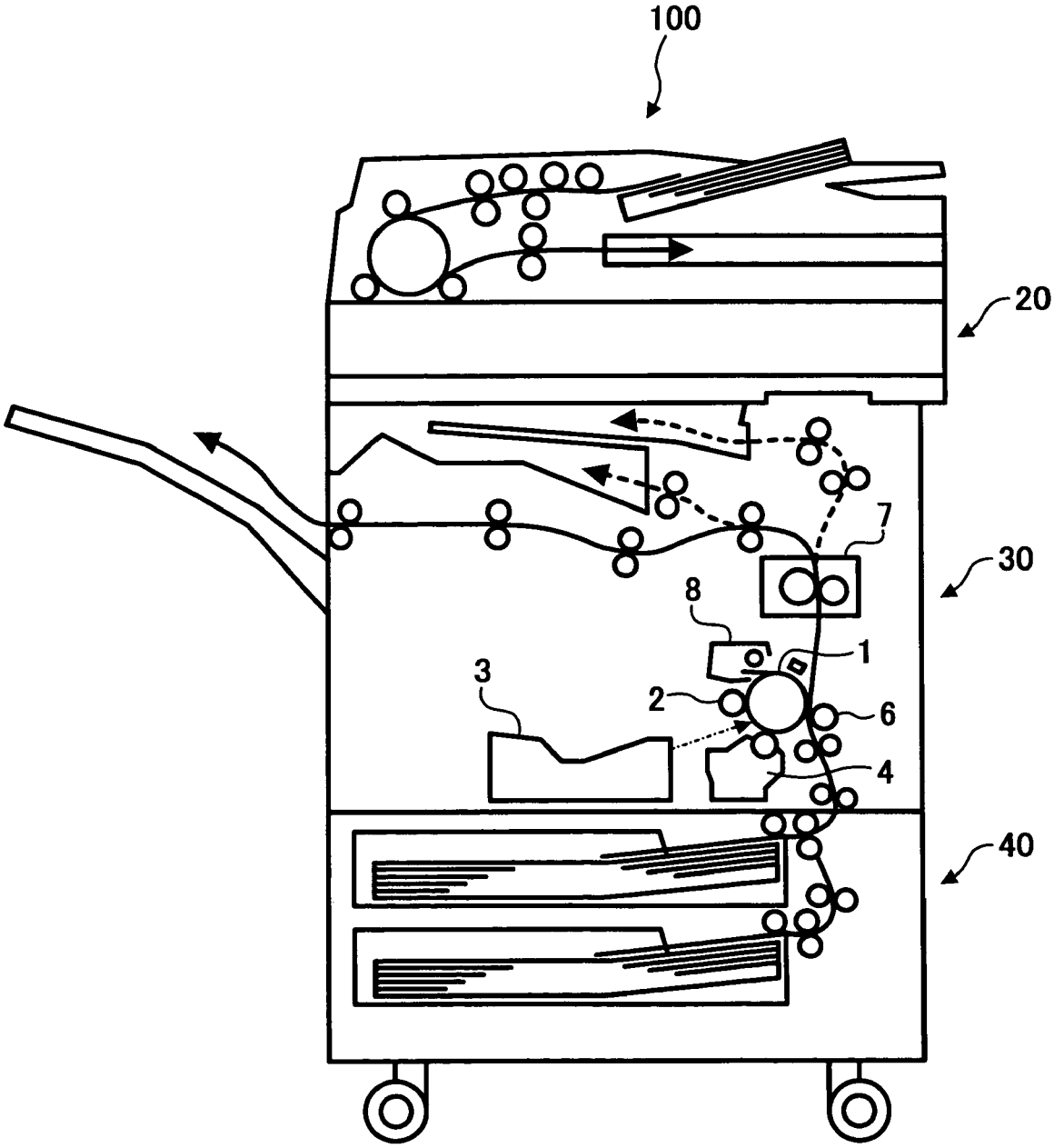
FIG. 3 is a schematic view illustrating an embodiment of the image forming apparatus of the present invention.

FIG. 3 is a schematic view illustrating the entire of an embodiment of the image forming apparatus of the present invention. FIG. 4 is a schematic view illustrating the image forming portion of the image forming apparatus illustrated in FIG. 3.

In FIG. 3, an image forming apparatus 100 (i.e., a copier) has an image reading unit 20 configured to read an image of an original, an image forming unit 30 configured to reproduce the original image, and a paper feeding unit 40 configured to feed a receiving material such as paper toward the image forming unit 30. The image forming unit 30 includes a photoreceptor 1, a charger 2 configured to charge the photoreceptor 1, a light irradiator 3 configured to irradiate the photoreceptor with light to form an electrostatic latent image, a developing device 4 configured to develop the electrostatic latent image with a developer including the toner of the present invention to form a toner image on the photoreceptor 1, and a transfer device 6 configured to transfer the toner image on the receiving material fed from the paper feeding unit 40. The toner image on the receiving material is fixed by a fixing device 7, resulting in formation of a hard copy. The copy is discharged on a paper tray. The surface of the photoreceptor 1 is cleaned by a cleaning device 8 after the image transfer process, so that the photoreceptor 1 is ready for the next image forming operations.

Figure 4:
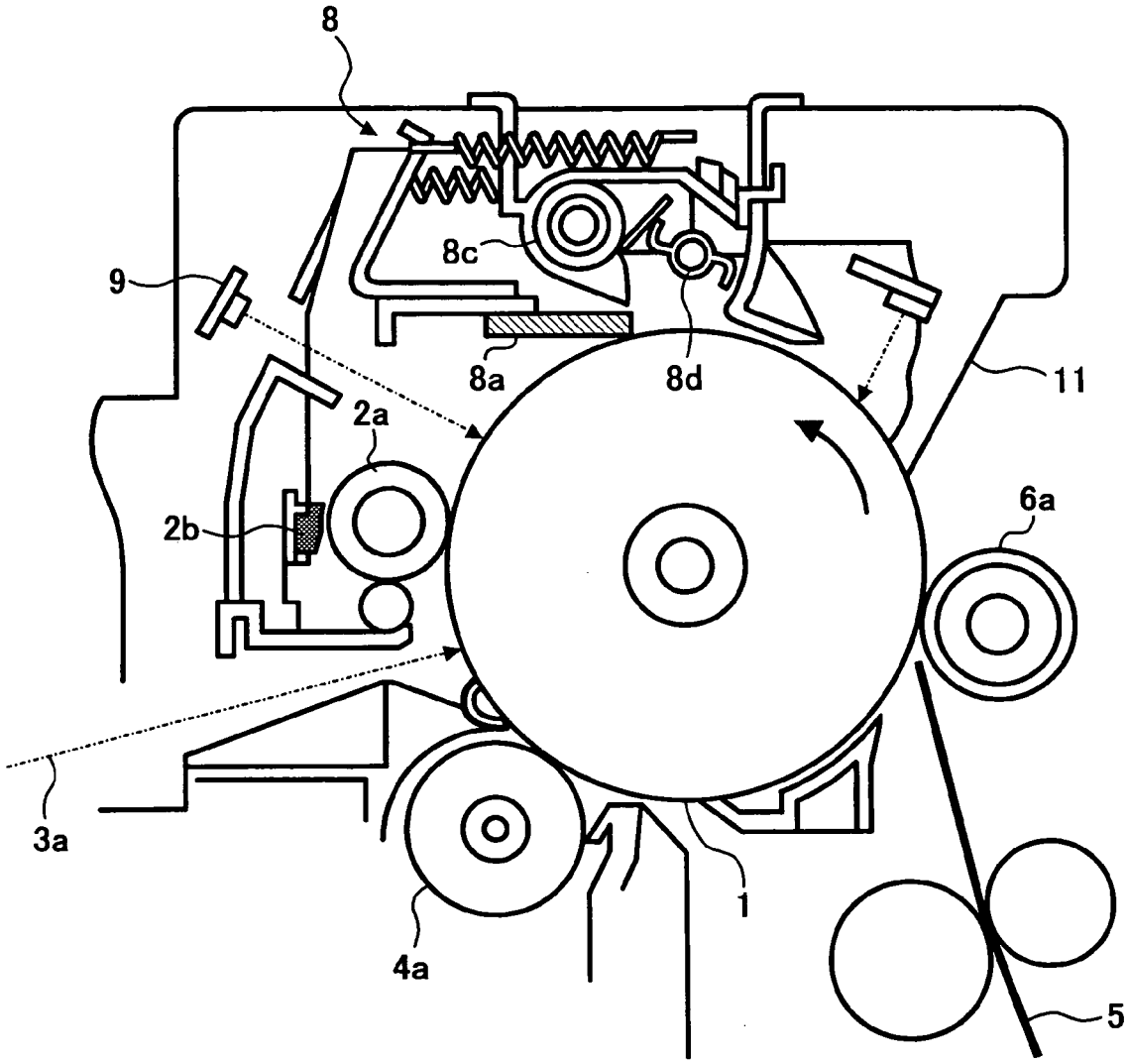
FIG. 4 is a schematic view illustrating an image forming portion of the image forming apparatus illustrated in FIG. 3.

The image forming operations will be further explained referring to FIG. 4.

The photoreceptor 1 rotates in a direction indicated by an arrow. At first, the surface of the photoreceptor 1 is entirely charged with a charging roller 2*a*. Numeral 2*b* denotes a temperature detector. Light 3*a* emitted from the light irradiating device 3 irradiates the charged photoreceptor 1 to form an electrostatic latent image on the surface of the photoreceptor 1. The electrostatic latent image on the photoreceptor 1 is developed with the toner in a developer layer formed on the surface of a developing roller 4*a* of the developing device 4. Thus, a toner image is formed on the surface of the photoreceptor 1. The toner image is transferred to a receiving material 5, which is fed from the paper feeding unit 40, at a nip between the photoreceptor 1 and a transfer roller 6*a* of the transfer device 6.

The receiving material 5, on which the toner image is transferred, is then separated from the photoreceptor 1 by a separation pick 11 to be conveyed to the fixing device 8. Then the surface of the photoreceptor 1 is cleaned by a cleaning blade 8*a* of the cleaning device 8. Numerals 8*c* and 8*d* denote a toner collecting coil and a toner collecting blade, which are used for collecting residual toner particles on the photoreceptor 1. Numeral 9 denotes a discharging lamp configured to discharge the charges remaining on the photoreceptor.

Figure 6:
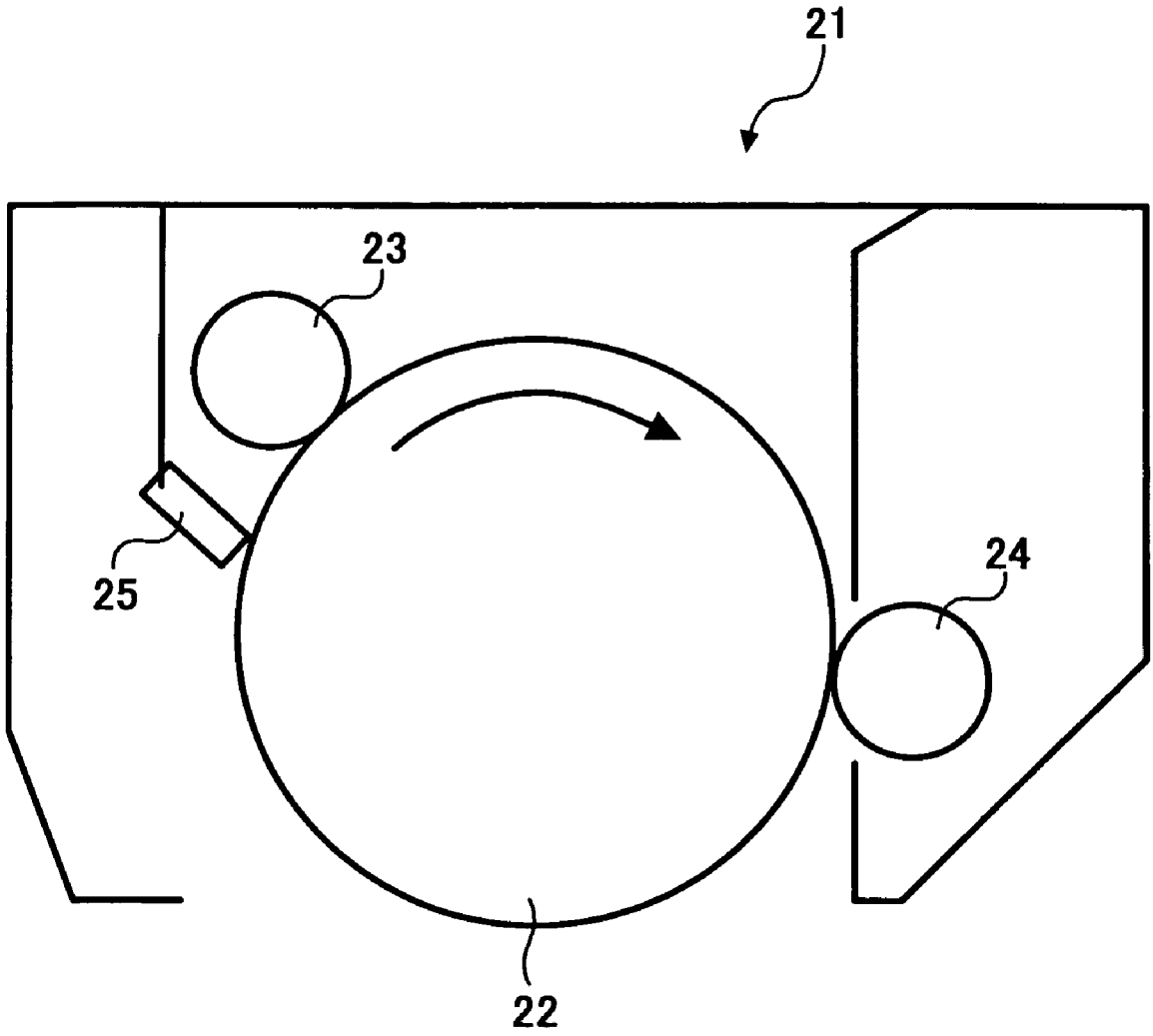
FIG. 6 is a schematic view illustrating an embodiment of the process cartridge of the present invention.

FIG. 6 is a schematic view illustrating the cross section of an embodiment of the process cartridge of the present invention. Numeral 21 denotes a process cartridge. The process cartridge 21 includes a photoreceptor 22 serving as an image bearing member bearing an electrostatic latent image thereon, a charger 23 which charges the photoreceptor 22, a developing roller 24 serving as a member of a developing device which develops the electrostatic latent image on the photoreceptor 22 with the developer of the present invention to form a toner image on the photoreceptor 22, and a cleaning blade 25 which serves as a cleaner and which removes toner particles remaining on the surface of the photoreceptor 22 after the toner image on the photoreceptor 22 is transferred onto a receiving material (not shown).

The process cartridge 21 is not limited to the process cartridge 1 illustrated in FIG. 6. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 22 is rotated at a predetermined rotation speed in a direction indicated by an arrow. The photoreceptor 22 is charged with the charger 23 and thereby the photoreceptor 22 is uniformly charged positively or negatively. Then an image irradiating device (not shown) irradiates the charged surface of the photoreceptor 22 with light using a method such as slit irradiation methods and laser beam irradiation methods, resulting in formation of electrostatic latent image on the photoreceptor 22.

The thus prepared electrostatic latent image is developed by the developing roller 24 bearing a developer including the toner of the present invention thereon, resulting in formation of a toner image on the photoreceptor 22. The toner image is then transferred onto a receiving material (not shown) which is timely fed by a feeding device (not shown) to a transfer position between the photoreceptor 22 and a transfer device (not shown).

The toner image formed on the receiving material is then separated from the photoreceptor 22 and fixed by a heat/pressure fixing device (not shown) including a fixing roller. The fixed image is discharged from the image forming apparatus. Thus, a hard copy is produced.

The surface of the photoreceptor 22 is cleaned by the cleaning blade 25 to remove toner remaining on the photoreceptor 22, followed by discharging, to be ready for the next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Unmodified Polyester

The following components were contained in a reaction container having a condenser, a stirrer and a nitrogen introducing tube and reacted for 8 hours at 230° C. under normal pressure.

| | |
|---|---|
| Adduct of bisphenol A with 2 mole of ethylene oxide | 690 |
| Terephthalic acid | 208 |

Then the reaction was further continued for 5 hours under a reduced pressure of from 10 to 15 mmHg, followed by cooling to 160° C. Further, 18 parts of phthalic anhydride were added thereto to perform a reaction for 2 hours at 160° C. Thus, an unmodified polyester (B) was prepared.

Preparation of Prepolymer

The following components were contained in a reaction container having a condenser, a stirrer and a nitrogen introducing tube and reacted for 8 hours at 230° C. under normal pressure.

| | |
|---|---|
| Adduct of bisphenol A with 2 mole of ethylene oxide | 800 |
| Isophthalic acid | 180 |
| Terephthalic acid | 60 |
| Dibutyl tin oxide | 2 |

Then the reaction was further continued for 5 hours under a reduced pressure of from 10 to 15 mmHg while removing water, followed by cooling to 160° C. Further, 32 parts of phthalic anhydride were added thereto to perform a reaction for 2 hours at 160° C.

Then the reaction product was cooled to 80° C., and reacted with 170 parts of isophorone diisocyanate in ethyl acetate for 2 hours. Thus, a prepolymer (A) having an isocyanate group was prepared.

Preparation of Ketimine Compound

In a reaction container having a stirrer and a thermometer, 30 parts of isophorone diamine and 70 parts of methyl ethyl ketone were contained and reacted for 5 hours at 50° C. to prepare a ketimine compound (1).

Preparation of Toner Particles

In a beaker, 14.3 parts of the prepolymer (A), 55 parts of the polyester (B) and 78.6 parts of ethyl acetate were mixed to prepare a solution. Then 10 parts of a rice wax serving as a release agent and having a melting point of 83° C., and 4 parts of a copper phthalocyanine blue pigment were added to the solution and the mixture was agitated by a TK HOMOMIXER for 5 minutes at 60° C. and at a revolution of 12,000 rpm, followed by dispersion for 30 minutes at 20° C. using a bead mill. Thus, a toner composition liquid (1) was prepared.

Further, in a beaker, 306 parts of deionized water, 265 parts of a 10% suspension of tricalcium phosphate, 0.2 parts of sodium dodecylbenzene sulfonate were mixed to prepare a solution. Then the solution was mixed with 161.9 parts of the toner composition liquid (1) and 2.7 parts of the ketimine compound (1) using a TK HOMOMIXER at a revolution of 12,000 rpm to perform a urea reaction. In this case, the particle diameter and particle diameter distribution of the particles were checked using a microscope. If the particle diameter was too large, the mixing operation was further continued for 5 minutes at a revolution of 14,000.

In a round-bottom flask equipped with a stirrer and a thermometer, 500 g of the mixture were heated to 45° C. and agitated for 2 hours at a revolution of from 200 to 400 rpm. Thus, an emulsion including particles having a spindle form was prepared. In this case, if the spindle form is not a desired form, the agitation is further continued.

The thus prepared emulsion was subjected to a solvent-removing treatment for one hour, followed by filtering, washing, drying and air classifying. Thus, toner particles having a spindle form and a volume average particle diameter of 5.1 μm were prepared.

One hundred parts of the thus prepared toner particles and 0.25 parts of a charge controlling agent (BONTRON E-82 from Orient Chemical Industries Ltd.) were mixed in a Q-form mixer manufactured by Mitsui Mining Co., Ltd., under the following conditions:

Peripheral speed of turbine blade: 50 m/sec; and

Mixing operation: a cycle in which rotation is performed for 2 minutes followed by a pause for 1 minute was performed 5 times.

Further, 0.5 parts of a hydrophobized silica (H2000 from Clariant Japan) were added to the toner particles, and the mixture was agitated by the Q-form mixer under a mixing condition such that a cycle in which rotation is performed for 0.5 minutes followed by a pause for 1 minute was performed 5 times.

Figure 5A:
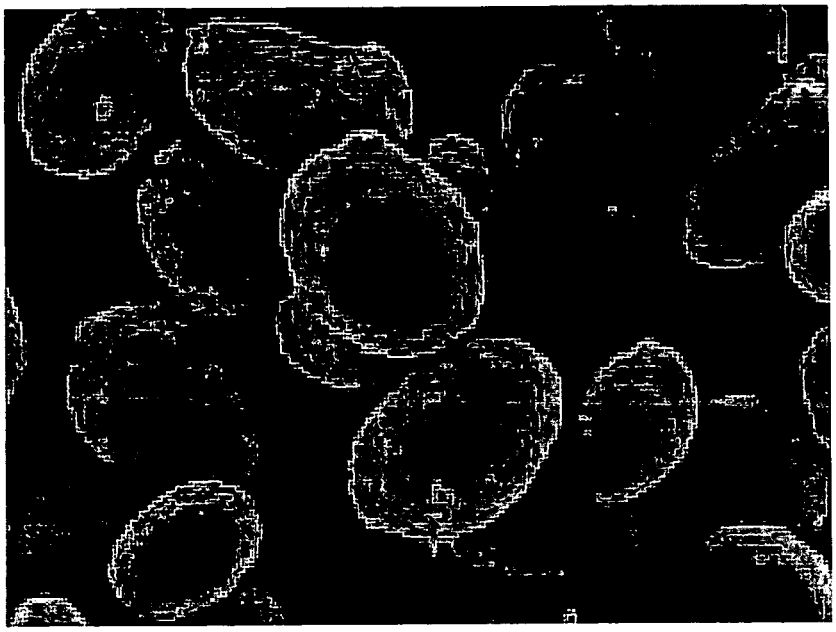
FIGS. 5A to 5D are photographs of the toner particles prepared in Examples 1 and 2 and Comparative Examples 1 and 2.

Furthermore, 0.5 parts of a hydrophobized silica and 0.5 parts of a hydrophobized titanium oxide were mixed with the toner particles using a HENSCHEL mixer. Thus, a cyan toner of the present invention was prepared. The photograph of the toner particles is shown in FIG. 5A.

Example 2

Figure 5B:
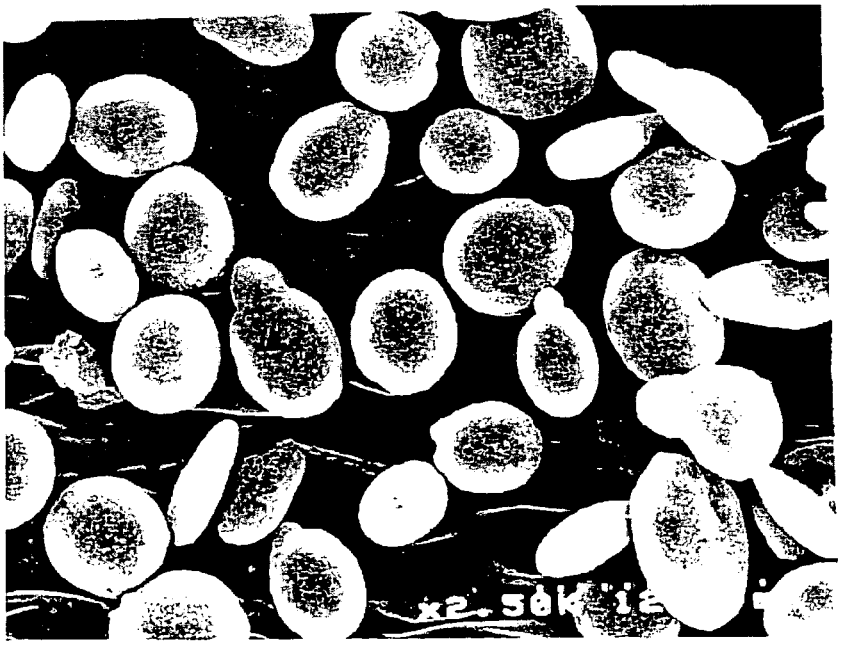

The procedure for preparation of the toner particles in Example 1 was repeated except that the revolution of the stirrer was changed from 200 to 400 rpm to 500 to 600 rpm. As clearly understood from the photograph as shown in FIG. 5B, the toner particles has a spindle form and a projection is formed on an end portion thereof. The toner particles have a volume average particle diameter, r1, r2 and r3 of 5.1 μm, 7.0 μm, 5.0 μm and 4.9 μm, respectively. Therefore, the ratios (r2/r1) and r3/r2) are 0.71 and 0.98, respectively. In addition, the standard deviations of r1, r2 and r3 are 2.0 μm, 1.1 μm and 1.0 μm, respectively.

Then the thus prepared toner particles were mixed with the charge controlling agent and the external additives in the same way as in Example 1. Thus, a cyan toner was prepared.

Comparative Example 1

The procedure for preparation of the toner particles in Example 1 was repeated except that the stirring at a revolution of from 200 to 400 rpm was not performed. As a result, toner particles having a spherical form and a volume average particle diameter of 4.9 μm were prepared.

Figure 5C:
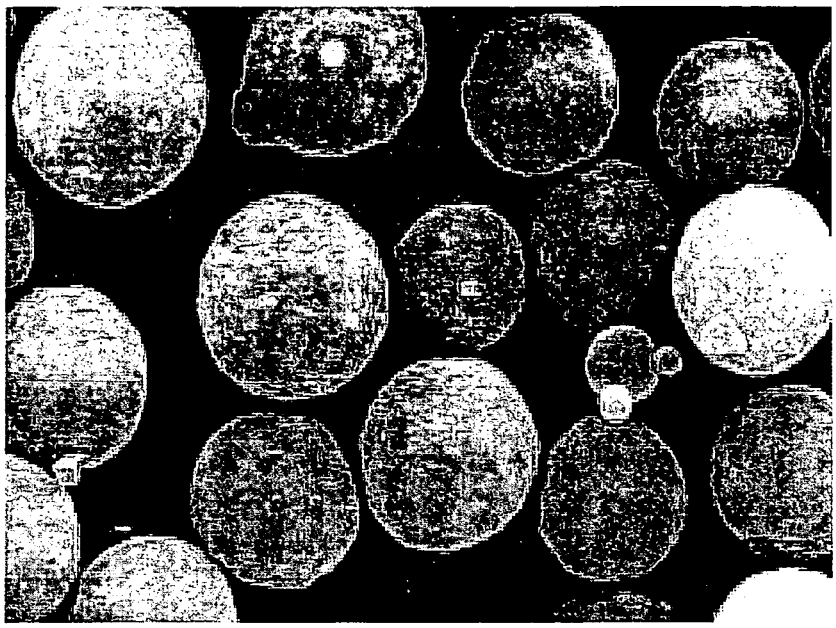

Then the toner particles were mixed with the charge controlling agent and the external additives in the same way as in Example 1. Thus, a comparative cyan toner was prepared. The photograph of the toner particles is shown in FIG. 5C.

Comparative Example 2

A toner including a polyester resin prepared by a bisphenol diol and a polybasic carboxylic acid was prepared by a pulverization method.

Specifically, the following components were mixed with a HENSCHEL mixer.

| | |
|---|---|
| The polyester resin mentioned above (number average molecular weight Mn of 6,000, weight average molecular weight Mw of 50,000, glass transition temperature Tg of 61° C.) | 86 |
| Rice wax (acid value of 0.5 mgKOH/g) | 10 |
| Copper phthalocyanine blue pigment (Manufactured by Toyo Ink Mfg. Co., Ltd.) | 4 |

The mixture was kneaded for 40 minutes at a temperature of from 80 to 110° C. using a roll mill, followed by cooling. Then the kneaded mixture was pulverized and classified. Thus, toner particles having a volume average particle diameter of 5.2 μm was prepared.

Figure 5D:
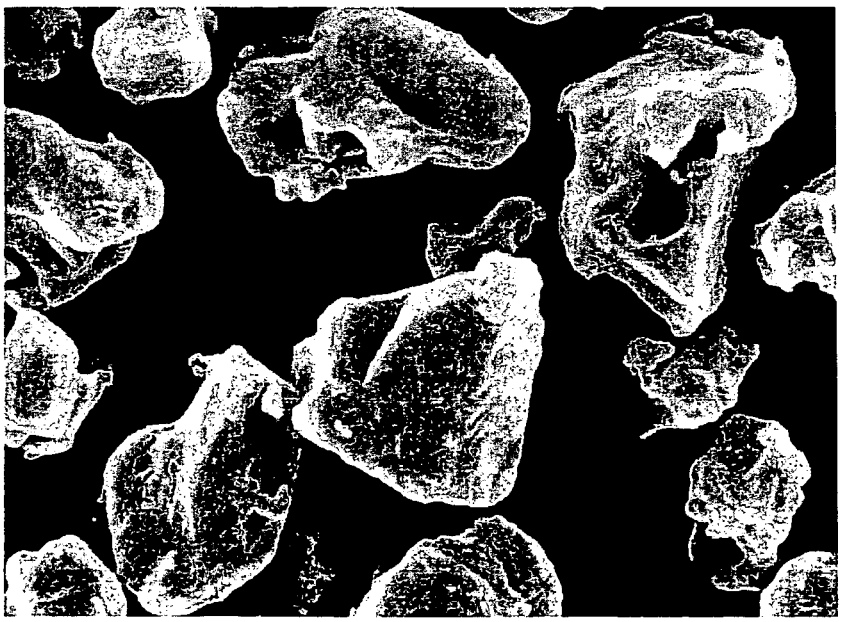

Then the toner particles were mixed with the external additives in the same way as in Example 1. Thus, a comparative cyan toner was prepared. The photograph of the toner particles is shown in FIG. 5D.

Three parts of each of the thus prepared toners were mixed with 97 parts of a ferrite carrier which had been coated with a silicone resin and which has a particle diameter of from 100 to 250 mesh, using a ball mill. Thus, two-component developers were prepared.

Each developer was set in an image forming apparatus, MF2800 manufactured by Ricoh Co., Ltd., to evaluate the developability, transferability and cleanability of each toner. The evaluation methods are as follows.

Evaluation Method (1) Developability

An image chart including a line image in which 5 pairs of a black line and a white line are arranged in a portion 1 mm wide was copied. The toner image on the image bearing member (i.e., photoreceptor) was visually observed using a loupe to evaluate the fine line reproducibility and to determine whether there are toner particles on white line images formed on the photoreceptor (i.e., to determine whether the fogging problem is caused in the toner image on the photoreceptor).

(2) Transferability

A black solid image was formed on a paper with a reel weight of 45 kg. The weight (Wp) of the toner on the paper and the weight (Wi) of the toner image on the image bearing member were measured to determine the weight ratio (Wp/Wi) (i.e., transfer rate).

In addition, the line image prepared above in (1) was transferred on a paper. The transferred toner image was visually observed to determine whether there are toner particles on while line images on the receiving paper (i.e., to determine whether the fogging problem is caused in the toner image on the receiving paper).

(3) Cleanability

Half tone images were formed on the photoreceptor and then removed by the cleaning blade to determine whether there remain toner particles on the photoreceptor. This cleaning operation was performed under an environmental condition of 10° C. and 10% RH, which is a severe condition for cleaning.

The developability, transferability and cleanability of the toners are classified into the following four grades:

◎: Excellent.

○: Good

Δ: Acceptable.

X: Unacceptable.

The results are shown in Table 1.

TABLE 1

| | Developability | | Transferability | | |
|---|---|---|---|---|---|
| | Fine line reproducibility | Fogging | Transfer rate | Fogging | Cleanability |
| Ex. 1 | ○ | ○ | ○ | ○ | ○ |
| Ex. 2 | ○ | ○ | ○ | ○ | ⊙ |
| Comp. Ex. 1 | ○ | X | ○ | X | X |
| Comp. Ex. 2 | X | ○ | X | ○ | ○ |

As can be understood from Table 1, the toner of Example 1 which has a spindle form and the toner of Example 2 which has a spindle form and which has a projection on an end portion thereof have good fine line developability without causing the fogging problem. The toner of Comparative Example 1, which has a spherical form, has good fine line developability but causes the fogging problem. The toner of Comparative Example 2, which has an irregular form, has poor fine line developability.

In addition, the toners of Examples 1 and 2 have high transfer rate without causing the fogging problem even when the toner images are transferred. The toner of Comparative Example 1 has high transfer rate but causes the fogging problem. The toner of Comparative Example 2 has low transfer rate but does not cause the fogging problem.

There remained no toner particles on the photoreceptor when a 100-copy running test was performed using the toners of Example 1 and Comparative Example 2. In addition, there remained no toner particles on the photoreceptor when a 1000-copy running test was performed using the toner of Example 2. In contrast, there remained toner particles on the photoreceptor when one copy was performed using the toner of Comparative Example 1.

Effects of the Present Invention

Thus, the present invention can form high quality images (i.e., good fine line reproducibility) on a photoreceptor without causing the fogging problem. In addition, the toner of the present invention has high transfer rate and does not cause the fogging problem in the transfer process. Further, the toner of the present invention has cleanability as good as that of toners having an irregular form. Furthermore, the charge quantity of particles of the toner of the present invention falls in a narrow range, and thereby high quality images can be produced without causing undesired images such as the background development.

This document claims priority and contains subject matter related to Japanese Patent Applications Nos. 2002-332493 and 2003-014068, filed on Nov. 15, 2002, and Jan. 22, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

toner particles comprising:

a binder resin; and a colorant, wherein the toner has such a rolling property as to relatively easily roll in one direction compared to other directions when the toner is present on a two-dimensional plane, wherein the toner satisfies the following relationships:

$$0.5 \leqq (r2/r1) \leqq 0.8,\ 0.7 \leqq (r3/r2) \leqq 1.0,\ \text{and}\ r3 \leqq r2 \leqq r1,$$

wherein r1, r2 and r3 represent an average major axis particle diameter, an average minor axis particle diameter and an average thickness of the toner particles, and wherein the toner has a charge quantity of from 15 to 40 μC/g and a charge quantity distribution such that a half width of a charge quantity distribution curve is from 0.5 to 4.0 f C/μm.

2. The toner according to claim 1, further comprising a charge controlling agent, wherein the charge controlling agent is fixed on a surface of the toner particles.

3. The toner according to claim 2, wherein a content of the charge controlling agent is from 0.2 to 2.0% by weight based on total weight of the toner.

4. The toner according to claim 1, wherein the toner particles have a spindle form and a volume average particle diameter of from 3 to 8 μm.

5. The toner according to claim 1, wherein the average major axis particle diameter r1 is from 5 to 9 μm, the average minor axis particle diameter r2 is from 2 to 6 μm, and the average thickness r3 is from 2 to 6 μm.

6. The toner according to claim 5, wherein standard deviations of the average major axis particle diameter r1, the average minor axis particle diameter r2 and the average thickness r3 are not greater than 2.0 μm, 1.5 μm and 1.5 μm, respectively.

7. The toner according to claim 5, wherein toner particles having a thickness r3 not greater than 3 μm are included in an amount not greater than 30% by weight based on the total weight of the toner.

8. The toner according to claim 1, wherein the toner has an average form factor SF-2 of from 100 to 190, wherein a form factor of a toner particle is defined by the following formula (1):

$$SF\text{-}2=\{(\text{PERI})^2/\text{AREA}\}\times(100\pi/4) \quad (1)$$

wherein PERT and AREA respectively represent a periphery length and an area of an image of a toner particle projected on a two-dimensional plane.

9. The toner according to claim 1, wherein particles of the toner relatively easily roll around a major axis direction thereof compared to other directions, and wherein a projection is present on an end portion of the particles in the major axis direction.

10. The toner according to claim 1, wherein the binder resin comprises a modified polyester resin.

11. The toner according to claim 10, wherein the toner particles are prepared by a method comprising:

dissolving or dispersing a toner composition, which comprises the modified polyester resin, in an organic solvent to prepare a toner composition liquid; and dispersing the toner composition liquid in an aqueous medium.

12. The toner according to claim 10, wherein the toner particles are prepared by a method comprising:

dissolving or dispersing a toner composition, which comprises a polyester prepolymer, in an organic solvent to prepare a toner composition liquid; and dispersing the toner composition liquid in an aqueous medium, wherein the modified polyester resin is prepared from the prepolymer during the dissolving or dispersing process and the second dispersing process.

13. The toner according to claim 1, wherein the binder resin comprises a modified polyester resin (i) and an unmodified polyester resin (ii), wherein a weight ratio (i/ii) is from 5/95 to 80/20.

14. The toner according to claim 1, wherein the binder resin has a peak molecular weight of from 1,000 to 10,000.

15. The toner according to claim 1, wherein the toner has a glass transition temperature of from 40 to 70° C.

16. The toner according to claim 1, further comprising an external additive which is present on the surface of the toner particles.

17. The toner according to claim 16, wherein the external additive is selected from the group consisting of hydrophobized silica and hydrophobized titanium oxide.

18. A developer comprising the toner according to claim 1 and a carrier.

19. An image forming apparatus comprising:

an image bearing member configured to bear an electrostatic latent image thereon;

a developing device configured to develop the electrostatic latent image with a developer including the toner according to claim 1 to form a toner image on the image bearing member, wherein said developing device contains said developer;

a transferring device configured to transfer the toner image onto a receiving material; and a cleaning device configured to clean a surface of the image bearing member.

20. A process cartridge for an image forming apparatus, comprising:

an image bearing member configured to bear an electrostatic latent image thereon; and a developing device configured to develop the electrostatic latent image with a developer comprising the toner according to claim 1 to form a toner image on the image bearing member, wherein said developing device contains said developer.

21. A toner comprising:

toner particles comprising:

a binder resin; and a colorant, wherein the toner has such a rolling property as to relatively easily roll in one direction compared to other directions when the toner is present on a two-dimensional plane, further comprising a charge controlling agent, wherein the charge controlling agent is fixed on a surface of the toner particles, wherein a content of the charge controlling agent is from 0.2 to 2.0% by weight based on total weight of the toner, wherein the toner particles have a spindle form and a volume average particle diameter of from 3 to 8 μm, and wherein the toner satisfies the following relationships:

$$0.5 \leqq (r2/r1) \leqq 0.8,\ 0.7 \leqq (r3/r2) \leqq 1.0, \text{and } r3\ r2 \leqq r1,$$

wherein r1, r2 and r3 represent an average major axis particle diameter, an average minor axis particle diameter and an average thickness of the toner particles, and wherein the toner has a charge quantity of from 15 to 40 μC/g and a charge quantity distribution such that a half width of a charge quantity distribution curve is from 0.5 to 4.0 f C/μm.

22. A toner comprising:

toner particles comprising:

a binder resin; and a colorant, wherein the toner has such a rolling property as to relatively easily roll in one direction compared to other directions when the toner is present on a two-dimensional plane, further comprising a charge controlling agent, wherein the charge controlling agent is fixed on a surface of the toner particles, wherein a content of the charge controlling agent is from 0.2 to 2.0% by weight based on total weight of the toner, wherein the toner satisfies the following relationships:

$$0.5 \leqq (r2/r1) \leqq 0.8,\ 0.7 \leqq (r3/r2) \leqq 1.0, \text{ and } r3\ r2 \leqq r2,$$

wherein r1, r2 and r3 represent an average major axis particle diameter, an average minor axis particle diameter and an average thickness of the toner particles, and wherein the average major axis particle diameter r1 is from 5 to 9 μm, the average minor axis particle diameter r2 is from 2 to 6 μm, and the average thickness r3 is from 2 to 6 C/μm, and wherein the toner has a charge Quantity of from 15 to 40 μC/g and a charge quantity distribution such that a half width of a charge quantity distribution curve is from 0.5 to 4.0 f C/μm.

* * * * *